US005649816A

United States Patent [19]

Wallis et al.

[11] Patent Number: 5,649,816

[45] Date of Patent: Jul. 22, 1997

[54] HERMETIC COMPRESSOR WITH HEAT SHIELD

[75] Inventors: Frank S. Wallis, Sidney; Jeffery D. Ramsey, Englewood; Timothy R. Houghtby, Sidney; Joseph V. Roebke, Lima, all of Ohio

[73] Assignee: Copeland Corporation, Sidney, Ohio

[21] Appl. No.: 317,551

[22] Filed: Oct. 3, 1994

Related U.S. Application Data

[63] Continuation-in-part of Ser. No. 95,185, Jul. 23, 1993, Pat. No. 5,358,391, which is a continuation-in-part of Ser. No. 978,947, Nov. 18, 1992, abandoned, and Ser. No. 998,557, Dec. 30, 1992, abandoned, which is a division of Ser. No. 884,412, May 18, 1992, Pat. No. 5,219,281, which is a division of Ser. No. 649,001, Jan. 31, 1991, Pat. No. 5,114,322, which is a division of Ser. No. 387,699, Jul. 31, 1989, Pat. No. 4,992,033, which is a division of Ser. No. 189,485, May 2, 1988, Pat. No. 4,887,382, which is a division of Ser. No. 899,003, Aug. 22, 1986, Pat. No. 4,767,293.

[51] Int. Cl.[6] ..... F04C 18/04; F04C 29/04; F04B 39/06

[52] U.S. Cl. ..... 418/55.1; 418/83; 418/181; 417/313; 417/902

[58] Field of Search ..... 418/55.1, 83, 181, 418/270; 417/313, 902

[56] References Cited

U.S. PATENT DOCUMENTS

| | | | |
|---|---|---|---|
| Re. 33,652 | 7/1991 | Yamamura et al. | 418/55.1 |
| 2,928,589 | 3/1960 | Davey . | |
| 3,802,809 | 4/1974 | Vulliez | 418/5 |
| 4,347,043 | 8/1982 | Morris | 417/53 |
| 4,497,615 | 2/1985 | Griffith | 417/310 |
| 4,609,334 | 9/1986 | Muir et al. | 418/57 |
| 4,696,630 | 9/1987 | Sakata et al. | 418/57 |
| 4,744,737 | 5/1988 | Yamamura et al. | 417/902 |
| 4,767,293 | 8/1988 | Caillat et al. | 418/57 |
| 4,877,382 | 10/1989 | Caillat et al. | 418/57 |
| 4,904,165 | 2/1990 | Fraser, Jr. et al. | 417/312 |
| 4,904,169 | 2/1990 | Ichikawa | 418/55.2 |
| 4,958,993 | 9/1990 | Fujio | 418/55.3 |
| 4,992,033 | 2/1991 | Caillat et al. | 418/55.3 |
| 5,055,012 | 10/1991 | Sakashita et al. | 418/55.1 |
| 5,071,323 | 12/1991 | Sakashita et al. | 418/55.1 |

FOREIGN PATENT DOCUMENTS

| | | | |
|---|---|---|---|
| 58-62397 | 4/1983 | Japan . | |
| 58-170877 | 10/1983 | Japan . | |
| 59-119092 | 7/1984 | Japan . | |
| 59-142485 | 9/1984 | Japan . | |
| 60-145483 | 7/1985 | Japan . | |
| 60-180785 | 11/1985 | Japan . | |
| 60-249683 | 12/1985 | Japan . | |
| 61-40473 | 2/1986 | Japan . | |
| 61-205386 | 9/1986 | Japan . | |
| 61-265377 | 11/1986 | Japan . | |
| 62-17391 | 1/1987 | Japan . | |
| 62-31785 | 2/1987 | Japan . | |
| 63-2891 | 1/1988 | Japan . | |
| 63-150489 | 6/1988 | Japan . | |
| 63-110685 | 7/1988 | Japan . | |
| 64-8389 | 1/1989 | Japan . | |
| 64-32089 | 2/1989 | Japan . | |
| 64-44387 | 3/1989 | Japan . | |
| 64-56981 | 3/1989 | Japan . | |
| 64-36691 | 3/1989 | Japan . | |
| 64-44386 | 3/1989 | Japan . | |
| 1-170780 | 7/1989 | Japan . | |
| 1-170781 | 7/1989 | Japan . | |
| 1-144484 | 10/1989 | Japan . | |
| 2-227579 | 9/1990 | Japan . | |
| 5-33785 | 2/1993 | Japan | 418/55.1 |
| 5-195971 | 8/1993 | Japan . | |

*Primary Examiner*—John J. Vrablik
*Attorney, Agent, or Firm*—Harness, Dickey & Pierce, P.L.C.

[57] ABSTRACT

A heat shield is disposed in a hermetic compressor between a discharge port and a local area on an interior surface of the outer shell toward which relatively hot compressed gas is directed. The local area of the outer shell is thereby insulated from the high temperature of the discharge gas and the noise and vibrations that are often associated with hot gas impinging on the shell.

18 Claims, 5 Drawing Sheets

HERMETIC COMPRESSOR WITH HEAT SHIELD

CROSS-REFERENCE TO RELATED APPLICATIONS

The present invention is a continuation-in-part of Ser. No. 95,185, filed Jul. 23, 1993, now U.S. Pat. No. 5,358,391, which is a continuation-in-part of Ser. No. 07/978,947, filed Nov. 18, 1992, now abandoned, and Ser. No. 07/998,557, filed Dec. 30, 1992, now abandoned, which is a division of Ser. No. 07/884,412, filed May 18, 1992, now U.S. Pat. No. 5,219,281, which is a division of Ser. No. 07/649,001, filed Jan. 31, 1991, now U.S. Pat. No. 5,114,322, which is a division of Ser. No. 07/387,699, filed Jul. 31, 1989, now U.S. Pat. No. 4,992,033, which is a division of Ser. No. 07/189,485, filed May 2, 1988, now U.S. Pat. No. 4,877,382, which is a division of Ser. No. 06/899,003, filed Aug. 22, 1986, now U.S. Pat. No. 4,767,293, which relate generally to hermetic compressors, and more particularly to a hermetic compressor having a heat shield to prevent localized hot spots on the shell.

BACKGROUND AND SUMMARY OF THE INVENTION

Several types of hermetic gas compressors, such as scroll compressors and certain other rotary compressors, have a discharge port positioned so that relatively hot compressed gas is discharged toward a local area on the interior surface of the hermetic shell in which the compressor is disposed. The compressed discharge gas is generally relatively hot. However, under certain conditions, such as a loss of charge, system blocked fan operation, or transient operation at a high compression ratio, the discharge gas may become exceedingly hot. If this hot compressed gas impinges on the interior surface of the shell, an undesirable localized hot spot is formed, which can present a hazardous situation as well as reduce the strength and durability of the shell material. Further, when compressed gas impinges on the interior surface of the shell, noise and vibrations are transmitted directly to the shell which is undesirable.

It is therefore an object of the present invention to provide a heat shield to insulate the shell from the relatively hot discharge gas and the noise and vibration frequencies generated by the hot gas as well as to overcome the problems of the prior art.

These and other various advantages and features of the present invention will become apparent from the following description and claims, in conjunction with the appended drawings:

DETAILED DESCRIPTION OF THE PREFERRED EMBODIMENTS

The following description of the preferred embodiments is merely exemplary in nature, and is in no way intended to limit the invention, or its application or uses.

Figure 1:
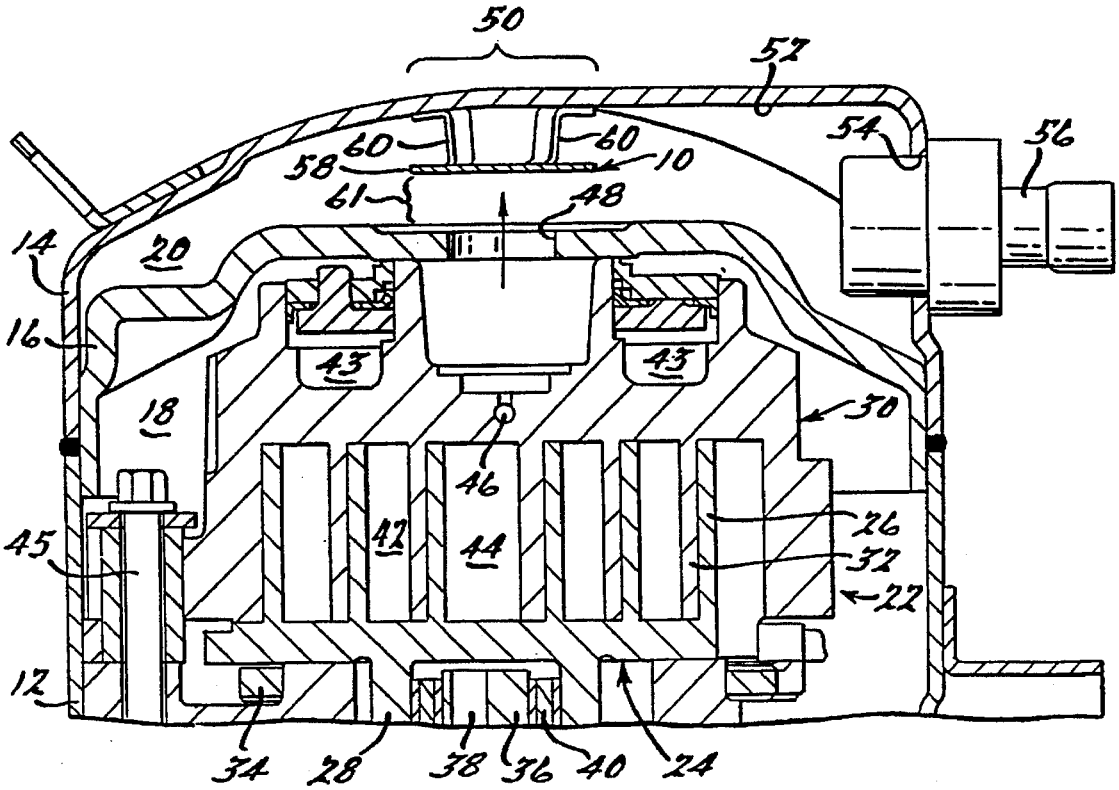
FIG. 1 is a partial cross-sectional view of a hermetic compressor incorporating the principles of the present invention, taken along line 1—1 in FIG. 3.
Figure 2:
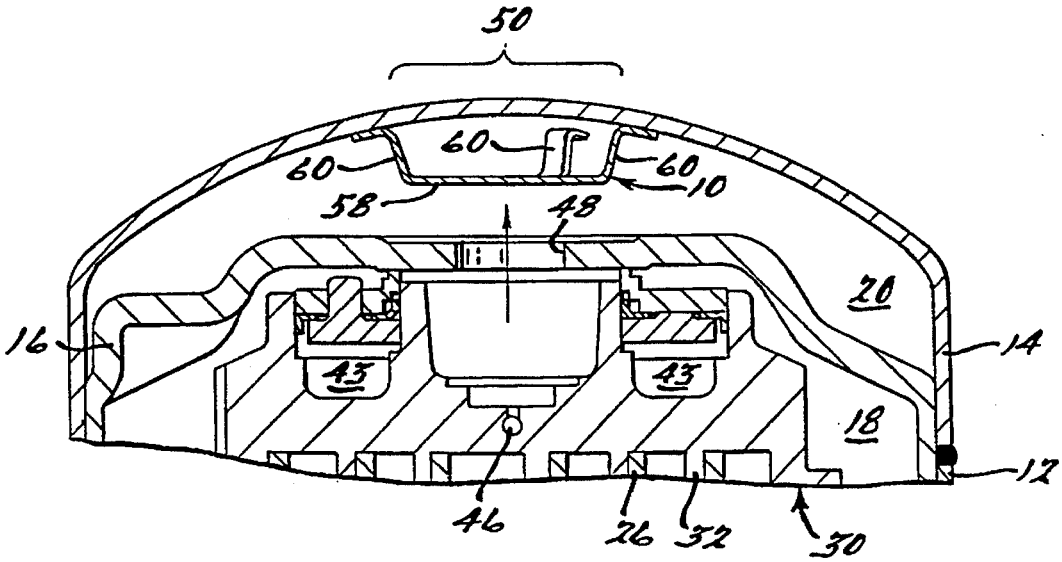
FIG. 2 is a view similar to FIG. 1 taken along line 2—2 in FIG. 3.
Figure 3:
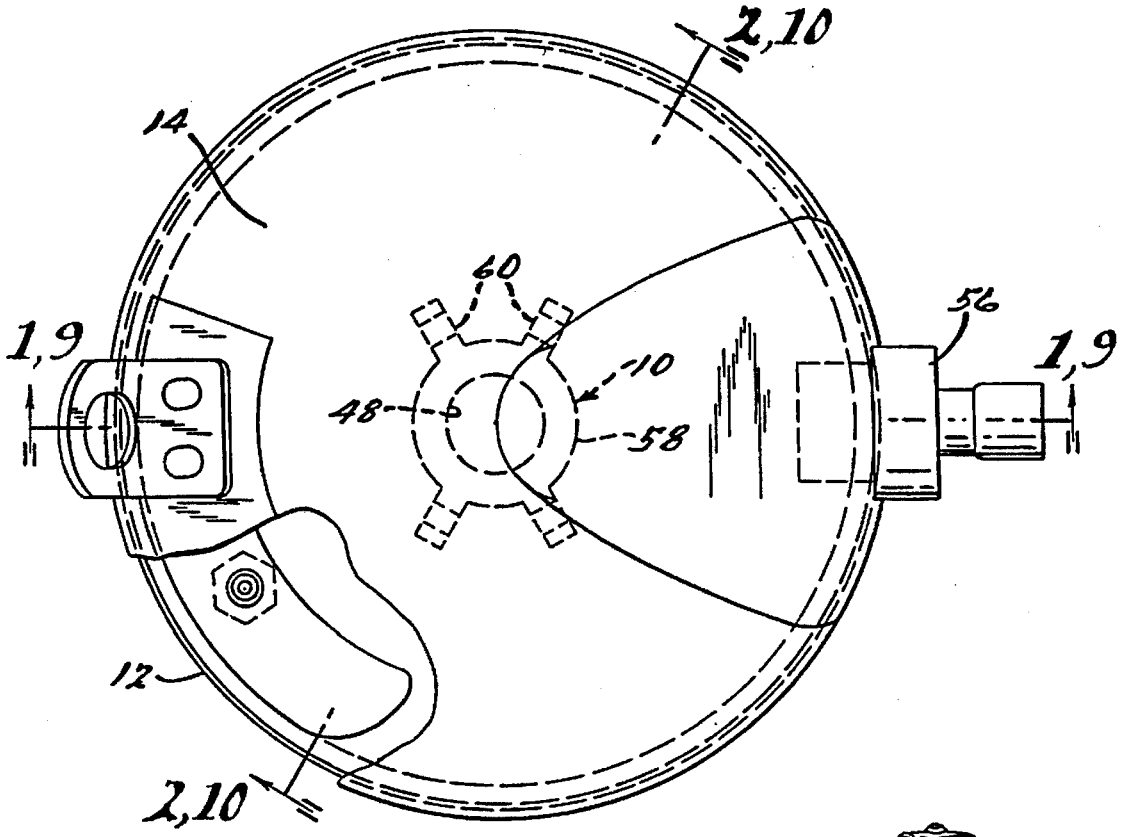
FIG. 3 is a top plan view of a hermetic compressor according to the present invention.

With reference to the drawings, a hermetic compressor is shown in FIGS. 1–3 having a novel heat shield 10 according to the present invention. Although the compressor is depicted as a scroll compressor, the heat shield 10 of the present invention 76 may be utilized with any compressor having a discharge port which can direct hot discharge gas against the interior surface of the hermetic shell. The compressor of FIGS. 1–3 is constructed of an exterior shell consisting of a sidewall 12 and a top cap 14 which are hermetically sealed together to define an enclosed chamber, with a muffler plate 16 dividing the enclosed chamber into a compressor chamber 18 and a muffler chamber 20. A variable capacity motor-compressor assembly 22 is contained within compressor chamber 18, and includes an orbiting scroll member 24 having a spiral wrap 26 and an axially extending boss 28, a non-orbiting scroll member 30 having a spiral wrap 32, an Oldham coupling 34, an eccentric portion of a drive shaft 36 having an oil passage 38, and a bushing 40 adapted for rotation within boss 28.

The compressor is similar to that disclosed in applicants' assignee's U.S. Pat. No. 5,102,316, the disclosure of which is hereby incorporated by reference. Drive shaft 36 rotates and causes orbiting scroll member 24 to engage in orbiting motion, while Oldham coupling 34 prevents orbiting scroll member 24 from rotating about its own axis. Spiral wraps 26 and 32 are interleaved and cooperate to form at least one compression space 42. As orbiting scroll 24 orbits, gas at suction pressure is drawn into compression space 42. The gas moves inwardly and the volume of compression space 42 decreases, thus compressing the gas. A small backpressure passage (not shown) is formed in the end plate of non-orbiting scroll member 30 which leads from compression space 42 to a backpressure chamber 43, for axially biasing non-orbiting scroll member 30 toward orbiting scroll member 24. Non-orbiting scroll member 30 is allowed to shift axially by a mounting arrangement which includes mounting bolt 45. The compressed gas reaches discharge pressure in discharge pressure chamber 44, proceeds through outlet tube 46, and then passes through discharge port 48 located in the muffler plate 16. The compressed gas at discharge pressure is discharged into muffler chamber 20 in a direction shown by the arrow in FIG. 1 toward a local area 50 defined on an interior surface 52 of cap 14. Finally, the compressed gas exits muffler chamber 20 through muffler exit port 54 and a one-way discharge valve 56.

Figure 4:
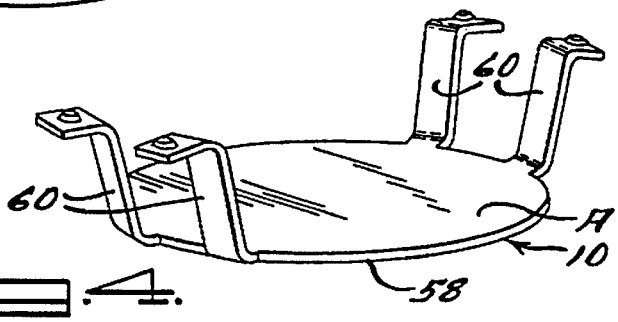
FIG. 4 is a perspective view of a heat shield according to the present invention.

The novel heat shield 10 of the present invention is disposed between discharge port 48 and local area 50 to insulate cap 14 from the relatively high temperature of the discharge gas. Heat shield 10 may be formed, as is shown in FIG. 4, as a sheet metal baffle having a plate-shaped deflector portion 58 and a plurality of legs 60. Legs 60 are bent so that deflector portion 58 of heat shield 10 may be spaced from cap 14 to reduce heat transfer from deflector portion 58 to cap 14 by conduction. Heat shield 10 is disposed a sufficient distance 61 from discharge port 48 to facilitate relatively unrestricted discharge flow, or at least not to restrict the discharge flow substantially more than in the absence of heat shield 10. The distance between discharge port 48 and heat shield 10 should preferably be greater than one-quarter of the hydraulic diameter of the port facing heat shield 10, which is discharge port 48 in the embodiment of FIGS. 1–3. The hydraulic diameter is defined as the square root of the following quantity: four multiplied by the perimeter of the port which faces heat shield 10 (discharge port 48) divided by the cross-sectional area of discharge port 48.

In addition, heat shield 10 defines a maximum effective insulating area which is approximately the area A of plate shaped deflector portion 58. This maximum effective insulating area may be no greater than 2½ times a maximum cross-sectional dimension of the port facing heat shield 10, which is discharge port 48 in the embodiment of FIGS. 1–3 and 9–10. Because the heat shield 10 is preferably effective to reduce the temperature of local area 50 below 392° F., area A is preferably selected to be no larger than necessary to do so.

Figure 5:
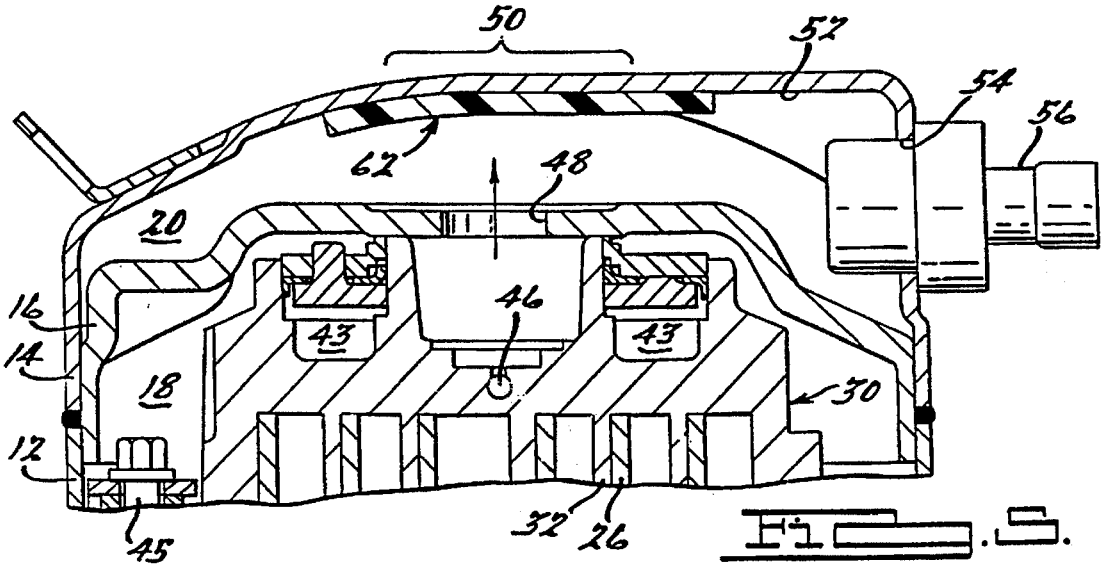
FIG. 5 is a partial cross-sectional view similar to FIG. 1 showing an alternative embodiment of the present invention.

An alternative embodiment of the present invention is shown in FIG. 5, in which identical reference numerals represent similar features. Heat shield 62 is formed as a layer of material which has an insulating effect, and is affixed to interior surface 52 of cap 14. Heat shield 62 may be formed of a variety of insulating materials, for example a polymer such as PEEK, or a ceramic such as partially stabilized zirconia. Heat shield 62 is positioned to cover local area 50 and insulate cap 14 from the relatively hot discharge gases flowing through discharge port 48. Heat shield 62 is preferably formed having a maximum effective insulating area which is no greater than 2½ times a maximum cross-sectional dimension of discharge port 48.

Figure 6:
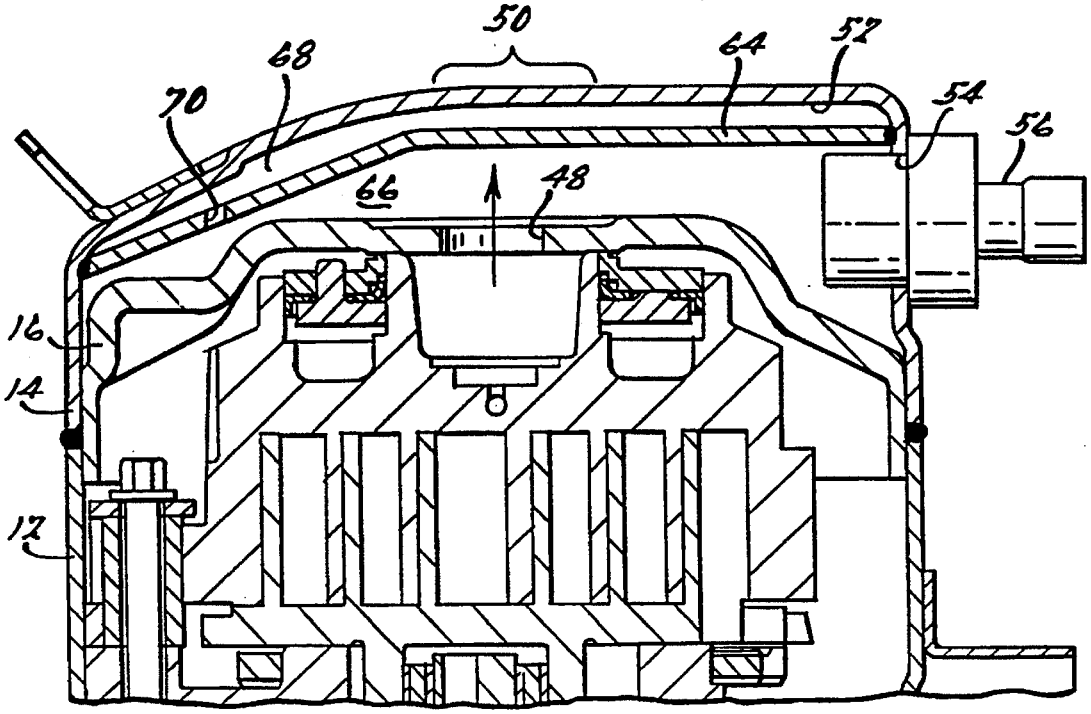
FIG. 6 is a partial cross-sectional view of a second alternative embodiment of the present invention.

A second alternative embodiment of the present invention is depicted in FIG. 6, in which the compressor includes a heat shield 64 which is formed as a diaphragm extending across a majority of the interior surface 52 of cap 14. Heat shield 64 segregates the volume of cap 14 into a discharge or plenum chamber 66 and an insulating chamber 68. Insulating chamber 68 contains relatively stagnant or non-moving gas which tends to insulate cap 14, and especially local area 50, from the relatively hot discharge gas. Heat shield 64 may also be formed with a vent passage 70 for balancing the pressures of the gas within plenum chamber 66 and insulating chamber 68, so that heat shield 64 need not be constructed to withstand the full discharge pressure produced by the compressor. Insulating chamber 68 has no other exit besides vent passage 70, so that the discharge gas flows generally from discharge port 48 to exit port 54, and not through vent passage 70. As a result, heat shield 64 is formed having no flow passage in a discharge flow path between discharge port 48 and exit port 54.

Figure 7:
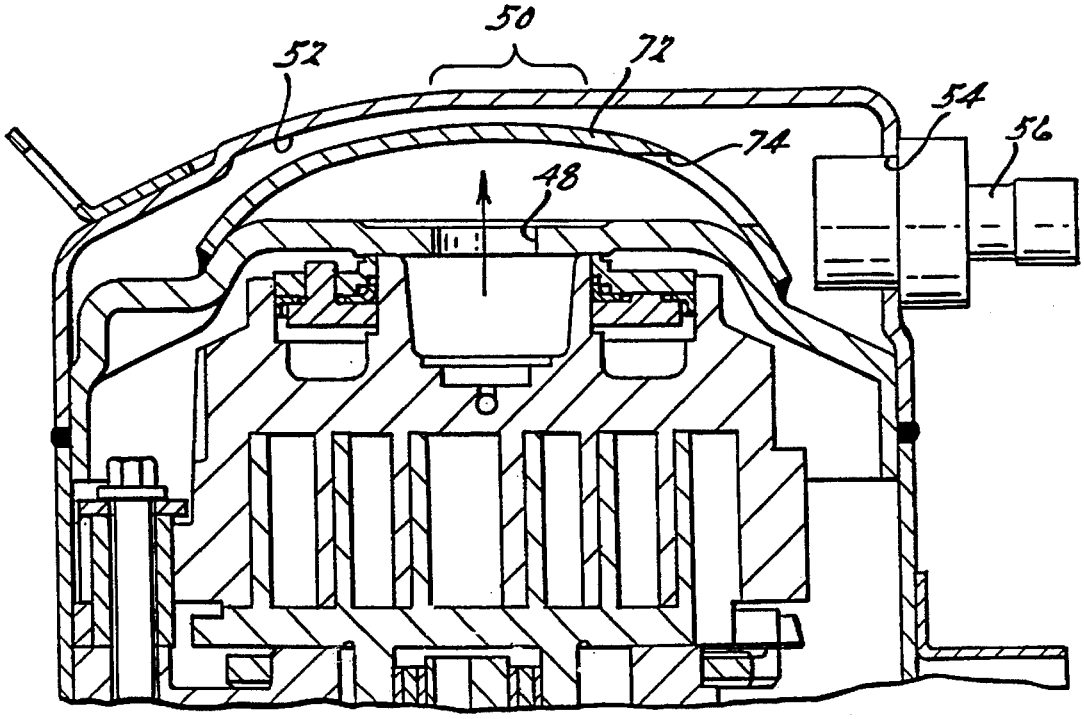
FIG. 7 is a partial cross-sectional view of a third alternative embodiment of the present invention.

A third alternative embodiment of the present invention is shown in FIG. 7, wherein the compressor includes a heat shield 72 which is affixed to muffler plate 16 and is disposed between discharge port 48 and local area 50. Heat shield 72 has an opening 74 which allows the compressed discharge gas to pass therethrough, along a flow path between discharge part 48 and exit port 54.

Figure 8:
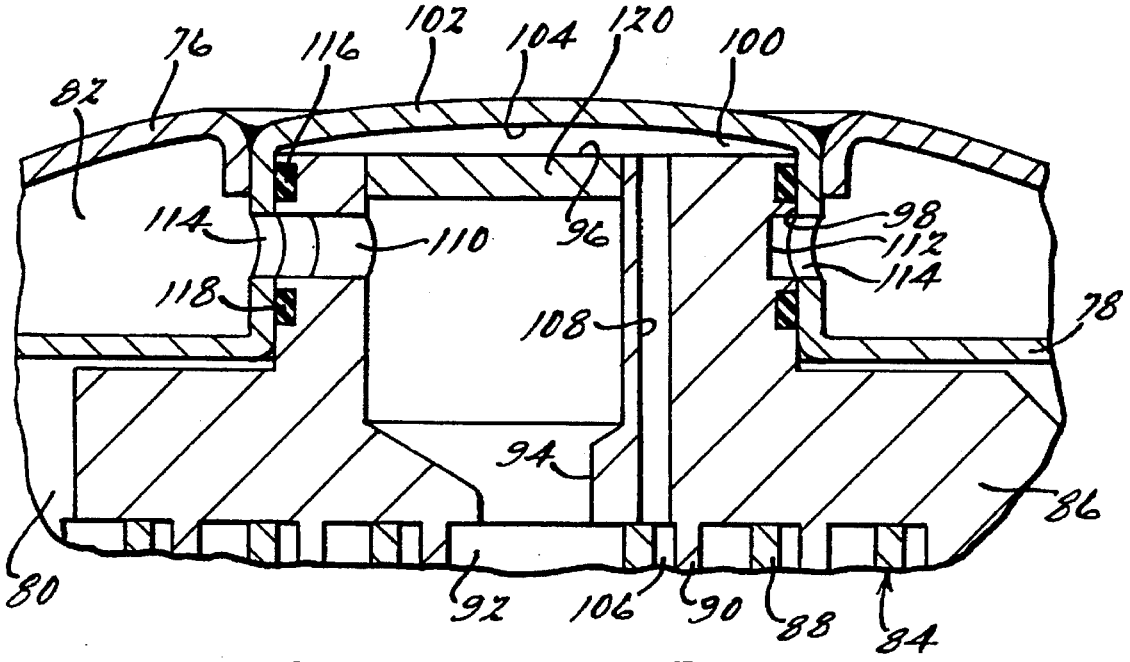
FIG. 8 is an enlarged fragmentary vertical sectional view illustrating another embodiment of the present invention.

In the embodiment of FIG. 8, a scroll machine is shown which is constructed of an exterior shell consisting of a sidewall (not shown) and a top cap 76 which are hermetically sealed together, with a muffler plate 78 dividing the enclosed chamber into a compressor chamber 80 and a plenum chamber or discharge chamber 82. A compressor assembly is disposed within compressor chamber 80 and includes an orbiting scroll member 84 and a non-orbiting scroll member 86, each incorporating a spiral wrap 88 and 90 respectively. Orbiting and non-orbiting scroll members 84 and 86 cooperate to define a central chamber 92, which encloses a region of relatively high discharge pressure when the scroll machine is operated as a compressor. Non-orbiting scroll member 86 is provided with a discharge port 94 which communicates through a discharge passage with plenum chamber or muffler chamber 82, from which the compressed gas exits the scroll machine through an exit port (not shown).

Axial biasing is achieved through the use of compressed fluid at an intermediate pressure which is between suction and discharge pressure. This is accomplished by providing a piston face 96 on the top of non-orbiting scroll member 86, which is adapted to slide axially within a sleeve or cylinder chamber 98, defined by muffler plate 78. Of course, the opposite arrangement is possible, in which a sleeve or cylinder is adapted to slide axially with respect to a fixed piston face. A downpressure chamber 100 is defined by piston face 96 and a central portion 102 of muffler plate 78. Central portion 102 spans the area between the walls of cylinder 98, and is welded around its perimeter to top cap 14. Central portion 102 of muffler plate 78 thus forms the top center portion of the hermetic compressor exterior shell, and defines a local area 104 toward which the relatively hot discharge gas is directed. Downpressure chamber 100 is maintained at the intermediate pressure by tapping compressed fluid from an intermediate compression space 106 defined by spiral wraps 88 and 90, through a passage 108 to chamber 100. Downpressure chamber 100 thus promotes tip sealing by pressing non-orbiting scroll member 86 axially down into engagement with orbiting scroll member 84.

Discharge fluid flows from central chamber 92 through discharge port 94 into a radial passage 110 in non-orbiting scroll member 86 which connects with an annular groove 112, which is in direct communication with a series of openings 114 and discharge chamber 82. Elastomeric seals 116 and 118 provide the necessary sealing between discharge chamber 82 and both compressor chamber 80 and downpressure chamber 100.

In accordance with the principles of the present invention, a novel heat shield 120 is provided in the direct path of the relatively hot discharge gas, between discharge port 94 and local area 104. Heat shield 120 is preferably a planar disk affixed to an upper central portion of non-orbiting scroll member 86. Heat shield 120 is therefore disposed between downpressure chamber 100 and discharge port 94, where it serves the dual purposes of acting as a portion of piston face 96 for axially biasing non-orbiting scroll member 86 downwardly, as well as thermally insulating and protecting local area 104 for preventing a localized hot spot in the center of the exterior shell of the scroll machine.

Figure 9:
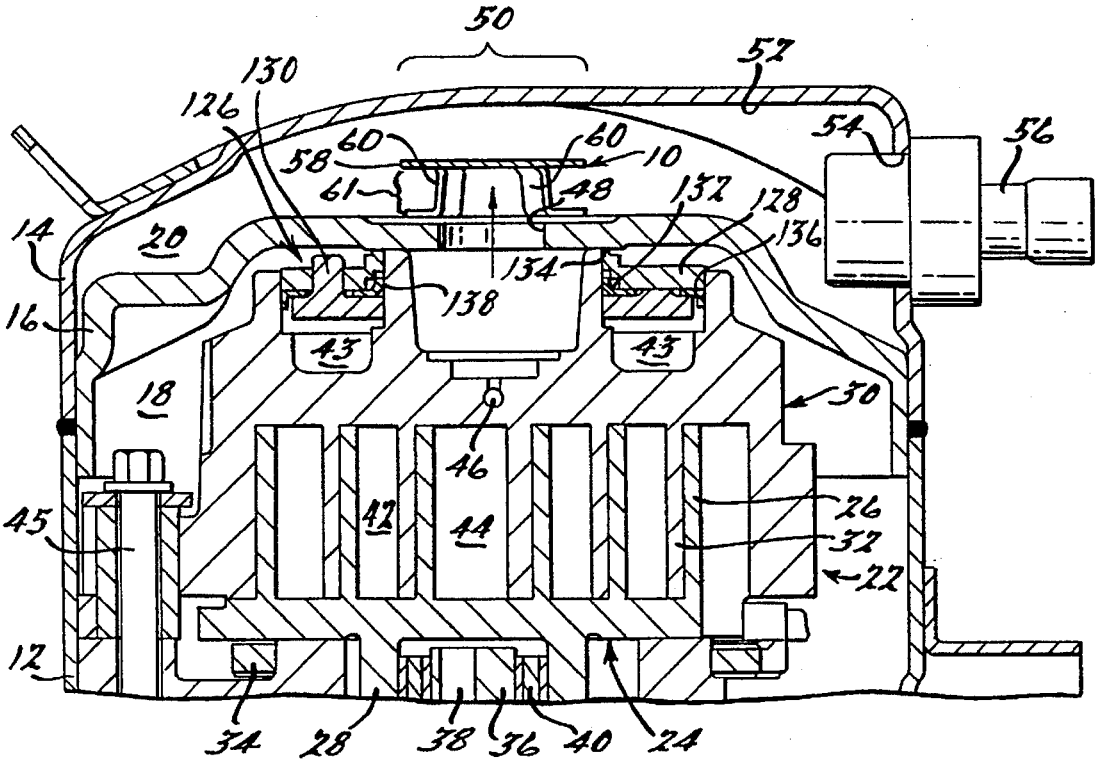
FIG. 9 is a partial cross-sectional view of yet another embodiment of the present invention, taken along line 1—1 in FIG. 3.

An alternative embodiment of the present invention is shown in FIG. 9, in which identical reference numerals represent similar features. In this embodiment the heat shield 10 is affixed to the muffler plate 16 preferably by a weld and is positioned between discharge port 48 and local area 50 to insulate cap 14 from relatively high temperature of the discharge gas as well as from the noise and vibration frequencies generated by the gas. The heat shield 10 maybe formed, as shown in FIG. 4, as a sheet metal baffle having a plate-shaped deflector portion 58 and a plurality of legs 60. The heat shield 10 is disposed a sufficient distance 61 from the discharge port 48 to facilitate relatively unrestricted discharge flow, or at least not to restrict the discharge flow substantially more than in the absence of the heat shield 10. The distance between discharge port 48 and heat shield 10 should preferably be greater than one-quarter of the hydraulic diameter of the port facing heat shield 10, which is discharge port 48 in the embodiment of FIGS. 1–3 and 9–10. Further, the shield 10 defines a maximum effective insulating area which is approximately the area A (see FIG. 4) of plate shaped deflector portion 58. This maximum effective insulating area may be no greater than 2½ times a maximum cross-sectional dimension of the discharge port 48.

Figure 10:
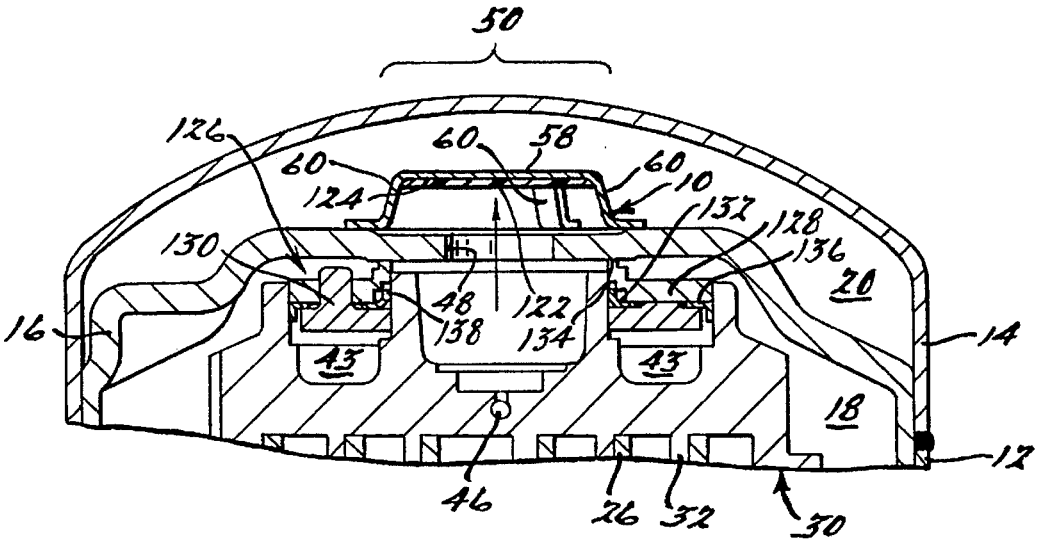
FIG. 10 is a partial cross-sectional view similar to FIG. 9 illustrating another embodiment of the present invention, taken along line 2—2 in FIG. 3.

In the embodiment disclosed in FIG. 10, yet another variation of the FIG. 9 heat shield 10 is disclosed. Here a layer of material 122, which has an insulating effect, is affixed to the interior surface 124 of the shield 10. It will be appreciated that the insulating material maybe formed of a variety of materials, for example, a polymer such as PEEK, or a ceramic such as partially stabilized zirconia. Such an arrangement enhances sound attenuation as well as increases the life of the heat shield 10.

With continued reference to FIGS. 9 and 10, the compressor includes a compressor chamber 18 at suction pressure, a back pressure chamber 43 at intermediate pressure and a discharge port 48 at discharge pressure. A floating seal assembly 126 is located within the compressor chamber 18. The seal assembly 126 is comprised of a first annular plate 128 and a second annular plate 130 that together sandwich an annular lip seal 132. A first seal 134 is located between the chamber at discharge pressure and the chamber at suction pressure. A second seal 136, the outer portion of annular lip seal 132, is located between the chamber at suction pressure and the chamber 43 at intermediate pressure. A third seal 138, the inner portion of annular lip seal 132, is located between the chamber 43 at intermediate pressure and the chamber at discharge pressure. The first seal 134 defines a seal between an upwardly extending portion of the first annual plate 128 and the underside of the muffler plate 16. The first seal 134 also engages an upwardly telescoping portion of the non-orbiting scroll member.

It will be further appreciated that the shield 10 may be constructed of materials other than metal and that a combination of materials could be employed. For example, a metal shield having a ceramic or polymer coating would assist in attenuating noise and insulating the shell from hot compressed gas.

It should be understood that an unlimited number of configurations of the present invention can be realized. The foregoing discussion discloses and describes merely exemplary embodiments of the present invention. One skilled in the art will readily recognize from the discussion and from the accompanying drawings and claims that various changes and modifications can be made without departing from the spirit and scope of the invention, as defined in the following claims.

What is claimed is:

1. A hermetic compressor comprising:

(a) the hermetic shell defining an enclosed chamber;

(b) a muffler plate dividing said enclosed chamber into a compressor chamber and a muffler chamber;

(c) a gas compressor disposed in said compressor chamber, said muffler plate having a discharge port from which relatively hot compressed gas is discharged from said gas compressor, said discharge port being positioned so that said hot compressed gas is discharged in a direction toward a local area on an interior surface of said shell;

(d) a heat shield affixed to said muffler plate and disposed between said port and said local area to insulate said shell from the relatively high temperature of said discharge gas, said heat shield having an opening allowing said compressed gas to pass therethrough; and (e) a seal member located between said gas compressor and said muffler plate.

2. The hermetic compressor as claimed in claim 1, wherein said heat shield is comprised of a one-piece deflector having a plurality of integral members for spacing said deflector from said muffler plate.

3. The hermetic compressor as claimed in claim 2, wherein said members are spaced apart and welded to said muffler plate.

4. The hermetic compressor as claimed in claim 1, wherein said heat shield is positioned between said muffler plate and said shell.

5. The hermetic compressor as claimed in claim 1, wherein said heat shield is effective during normal operation of the compressor to reduce a temperature of said local area to below 392 degrees fahrenheit.

6. The hermetic compressor as claimed in claim 1, wherein said heat shield has a maximum effective insulating area no greater than two and one-half times a maximum dimension of said discharge port.

7. The hermetic compressor as claimed in claim 1, wherein said heat shield is further comprised of a substantially planar baffle and a plurality of supportive members for affixing said baffle to said muffler plate and for spacing said baffle from said muffler plate.

8. The hermetic compressor as claimed in claim 1, wherein said heat shield has a plurality of openings and hot compressed gas is redirected towards a discharge member affixed to said shell.

9. A hermetic compressor comprising:

(a) a hermetic shell defining an enclosed chamber and having an exit port;

(b) a muffler plate affixed to and extending across the entire interior of said shell, said muffler plate dividing said shell into two separate chambers including a muffler chamber being located substantially above said muffler plate and a compression chamber being located entirely below said muffler plate, said muffler plate having a discharge port therethrough located centrally relative to said shell;

(c) a gas compressor disposed in said compressor chamber, said compressor comprising a first scroll member positioned below said muffler plate and a second scroll member located below the first scroll member, the first scroll member having a discharge opening from which relatively hot compressed gas is discharged, said discharge opening being positioned so that said hot compressed gas is discharged through said discharge opening in a direction toward a local area on an interior surface of said shell, said exit port being spaced from said local area, a floating seal between the discharge port of the muffler plate and the discharge opening of the first scroll member; and (d) a heat shield having a substantially planar baffle and a plurality of support members for affixing said baffle to said muffler plate and for spacing said baffle from said muffler plate, said heat shield being disposed between said discharge port and said local area to insulate said shell from the relatively high temperature of said discharge gas, said baffle being disposed a sufficient distance from said discharge port to facilitate relatively unrestricted discharge flow.

10. The hermetic compressor as claimed in claim 9, wherein said distance is greater than one-quarter of a hydraulic diameter of said port.

11. The hermetic compressor as claimed in claim 9, wherein said heat shield has a maximum effective insulating area no greater than two and one-half times a maximum cross-sectional dimension of said discharge port.

12. The hermetic compressor as claimed in claim 9, wherein said shield is formed of a layer of material having an insulating effect.

13. The hermetic compressor as claimed in claim 12, wherein said material is partially stabilized zirconia ceramic.

14. The hermetic compressor as claimed in claim 12, wherein said material is PEEK polymer.

15. The hermetic compressor as claimed in claim 9, wherein said heat shield is effective during normal operation to reduce a temperature of said local area to below 392 degrees fahrenheit.

16. A hermetic compressor comprising:

(a) a hermetic shell defining an enclosed chamber and having a gas compressor disposed in said enclosed chamber;

(b) a muffler plate positioned within said shell so as to define a sealed discharge chamber located substantially above said plate and a sealed compression chamber located substantially below said plate, a seal located below said plate, said seal being operable to separate a discharge pressure chamber from another pressure chamber that are both located within the compression chamber, said plate having a centrally located discharge port for directing hot compressed gas from said discharge pressure chamber towards said shell; and (c) a heat shield having a plurality of legs, which are each affixed to said muffler plate, said heat shield positioned between said shell and said muffler plate to assist in attenuating noise and insulating said shell.

17. The hermetic compressor as claimed in claim 16, wherein said compressor is located in said compression chamber, and said hot compressed gas is directed to said heat shield.

18. The hermetic compressor as claimed in claim 16, wherein said muffler plate extends across the entire interior of said shell and is affixed to said shell.

* * * * *

UNITED STATES PATENT AND TRADEMARK OFFICE

CERTIFICATE OF CORRECTION

PATENT NO. : 5,649,816

DATED : July 22, 1997

INVENTOR(S) : Frank S. Wallis; Jeffery D. Ramsey; Timothy R. Houghtby; Joseph V. Roebke It is certified that error appears in the above-indentified patent and that said Letters Patent is hereby corrected as shown below:

On the Title Page, under Related U.S. Application Data, line 9, "4,887,382" should be -- 4,877,382 --.

Column 3, line 65, "part" should be -- port --.

Column 7, line 11, "a" should be -- the --.

Column 8, line 15, delete ",".

Signed and Sealed this

Sixth Day of January, 1998

*Attest:*

*Attesting Officer*

BRUCE LEHMAN

*Commissioner of Patents and Trademarks*